United States Patent [19]

Hara

[11] 4,120,437

[45] Oct. 17, 1978

[54] CARRIER FOR SKIS AND SKI POLES

[76] Inventor: Clarence M. Hara, 2018 W. 150th St., Gardena, Calif. 90247

[21] Appl. No.: 794,825

[22] Filed: May 9, 1977

[51] Int. Cl.[2] ..... B65D 71/00

[52] U.S. Cl. ..... 224/45 S; 24/81 SK; 280/11.37 A

[58] Field of Search ..... 224/45 S, 45 R, 55; 280/11.37 A, 11.37 K; 24/81 SK, 16 R, 204, 81 AG, 81 CC, 73 SG

[56] References Cited

U.S. PATENT DOCUMENTS

| | | | |
|---|---|---|---|
| 3,279,008 | 10/1966 | Wallach | 224/55 |
| 3,383,738 | 5/1968 | Fox et al. | 24/204 |
| 3,486,672 | 12/1969 | Esopi | 224/45 S |
| 3,503,101 | 3/1970 | Kolozsvary | 24/204 |
| 3,543,977 | 12/1970 | Lockridge | 24/204 |
| 3,554,417 | 1/1971 | Yorty | 224/55 |
| 3,841,542 | 10/1974 | Hogensen, Jr. | 224/45 S |
| 3,947,927 | 4/1976 | Rosenthal | 280/11.37 A |

*Primary Examiner*—Trygve M. Blix
*Assistant Examiner*—Kenneth Noland
*Attorney, Agent, or Firm*—Wills, Green & Mueth Law Corporation

[57] ABSTRACT

A carrier for releasably engaging and supporting a pair of skis and a pair of ski poles in horizontal hand-carrying spaced relationship with the poles above the skis, whereby the poles function as a carrying handle. The carrier comprises a pair of flexible coupling straps, each of which includes a lower adjustable ski-engaging loop, on upper adjustable ski-pole-engaging loop, and a vertical intermediate hand-clearing web therebetween.

2 Claims, 3 Drawing Figures

S
16
17
R
18
19
U
T
11
20
W
B
H
2
15
T
R
18
16
10
19
S
20
10
2
H
F

T
15
P
X
F
15
Y
P
41
U
W
40
S
S
B
Y
F
13
12
X
12
13

T
F
41
U
W
F
40
F
F
B

CARRIER FOR SKIS AND SKI POLES

BACKGROUND OF THE INVENTION

Considerable time is necessarily expended by the ordinary skier in manually carrying his skis and ski poles from one location to another. For example, skiers usually carry their skis and ski poles from their automobiles or living quarters to the bottom of ski lift facilities operating on the slopes, or to ski runs on which they intend to ski.

As is well known, the conventional ski is an elongate, substantially rigid, flat-sided runner with a curved and pointed front end and a square rear end. A ski is of considerable weight, customarily has a pair of hard and relatively sharp edges, and has fastened thereto hard irregular binding hardware which projects from near its central portion. A pair of skis positioned in loose side-by-side or surface-to-surface juxtaposition for transporting purposes, presents a heavy assembly, the cross-section of which is excessively large to be effectively gripped in one's hand.

A conventional ski pole comprises an elongate semi-rigid shaft with a sharp point at one end, an annular stop disc in close proximity to the pointed end, a hand-grip at the other end portion of the shaft, and at times, a flexible, wrist-engaging band fastened to the hand grip. While such poles are not too heavy, they are difficult to carry in one hand because they tend to swing and move about, one relative to the other.

In the past, when manually carrying skies and ski poles from one location to another, it has been the practice for a skier to arrange his skis and ski poles in side-by-side relationship, and to carry them on one shoulder in a relatively loose bundle.

Apart from the difficulty of maintaining the bundled skis and ski poles together, the weight and the sharp edges and/or hardware on the skis tend to bear heavily on the skiers shoulder in such a manner as to frequently result in considerable discomfort.

In recent years the prior art has developed a number of ski and ski pole carrier structures with which related pairs of skis and ski poles are engaged in substantial balanced relationship, and which provide hand-grips such that the skis and poles in assembled relationship can be manually carried from one place to another.

The aforementioned prior art carriers are characteristically rigid or semi-rigid structures of considerable weight, and are of a size and shape which renders them unsuitable for skiers to carry with them when skiing. Accordingly, at some locations skiers must rent lockers at an additional cost in order to store the carriers. It is also common practice for skiers to use the carriers to transport their skis and poles to the bottoms of ski slopes and/or ski lifts and to leave the carriers unattended during the period of time they are engaged in skiing. And, in order to reduce the chance of theft of such unattended carriers, it is not unusual for skiers to chain and lock their carriers to trees and to other available structure of a permanent nature.

SUMMARY OF THE INVENTION

With the aforementioned limitations and deficiencies of prior art devices in mind, it is a primary object of the present invention to provide a novel carrier for manually carrying assembled skis and ski poles, which is relatively small in size and light in weight and which can be carried in the skier's pocket when not in use.

More particularly, it is an object to provide such a carrier which is flexible and relatively soft, to prevent injury therefrom if the skier were to fall on the carrier while it was being carried in his pocket.

Another object is to provide such a carrier which can be easily and quickly attached to the skis and ski poles and easily removed therefrom . . . while wearing gloves, in all types of weather, and even during darkness.

A further object is to provide such a novel carrier which is of universal size in that it can be used with all shapes and sizes of conventional skis and ski poles.

I have discovered that the above objects and advantages are achieved by the use of a pair of flexible coupling straps, each of which includes an adjustable lower ski-engaging loop, an upper adjustable ski pole-engaging loop, and a vertically extending intermediate web therebetween, whereby when such coupling straps are positioned in spaced-apart relationship with the lower ski-engaging loop encirclying and releasably holding a pair of skis in parallel, side-by-side relationship, and the upper ski pole-engaging loop encircling and releasably holding a pair of ski poles in parallel side-by-side relationship and spaced from the skis . . . the ski poles can be grasped between the spaced-apart coupling units adjacent the center of gravity of the assembly, and used as a handle in carrying the assembly from one location to another.

DESCRIPTION FO THE DRAWINGS

DESCRIPTION OF THE PREFERRED EMBODIMENT

Figure 1:
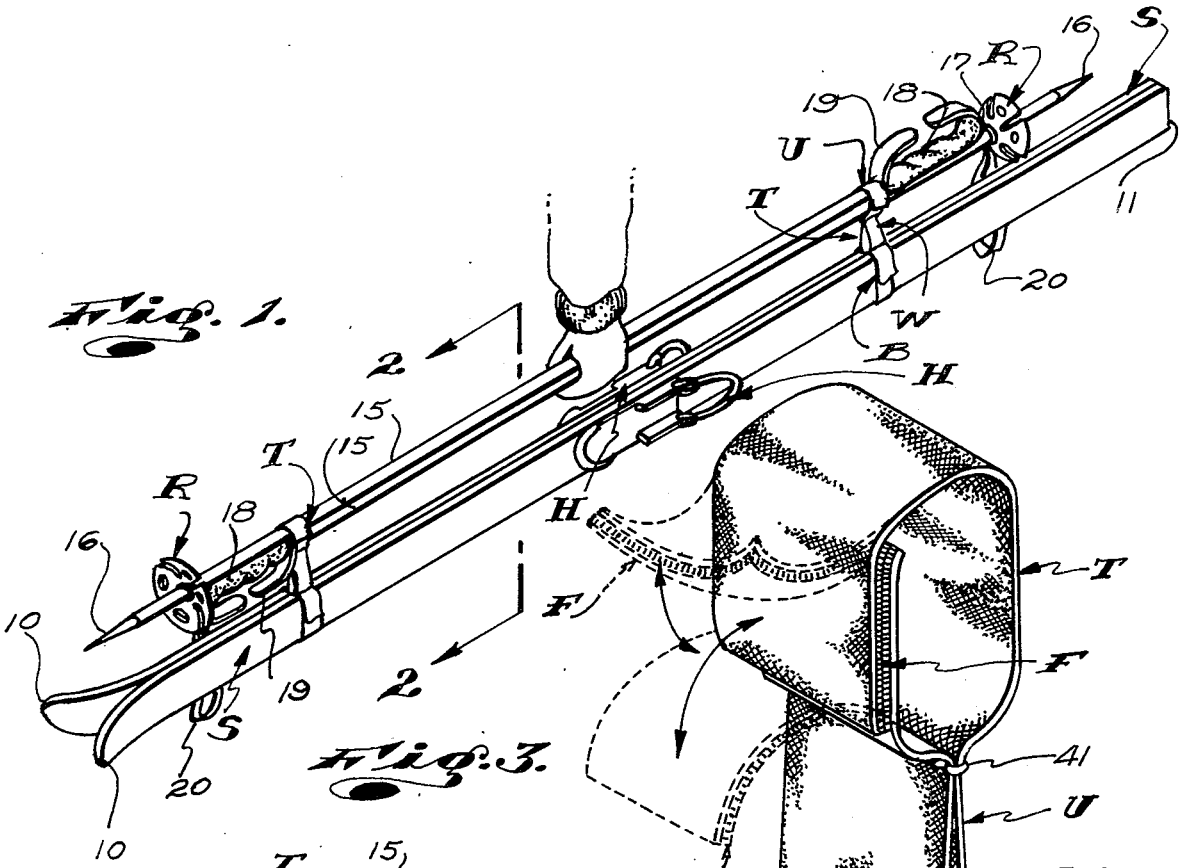
FIG. 1 is a prespective view of a novel carrier constructed in accordance with the teachings of the present invention.

In FIG. 1 of the drawings, there is shown the combination of a pair of skis S, a pair of ski poles P, and a pair of coupling units U, which embody the present invention.

The skis S are typical. They are elongate, substantially rigid runners with curved and pointed from ends 10, square rear ends 11, and flat, longitudinal sides. The sides of the skis comprise flat top surfaces 12, flat bottom surfaces 13, and flat sides or edges 14. The corners established by the edges 14 and bottom surfaces 13 are commonly provided with metal strips and are relatively sharp. The top surfaces of the skis S are provided with binding hardward H to facilitate securing the skis to the footware of the skier, which hardware is suitably located between the ends of the skis, rearwardly of the center of gravity.

Figure 2:
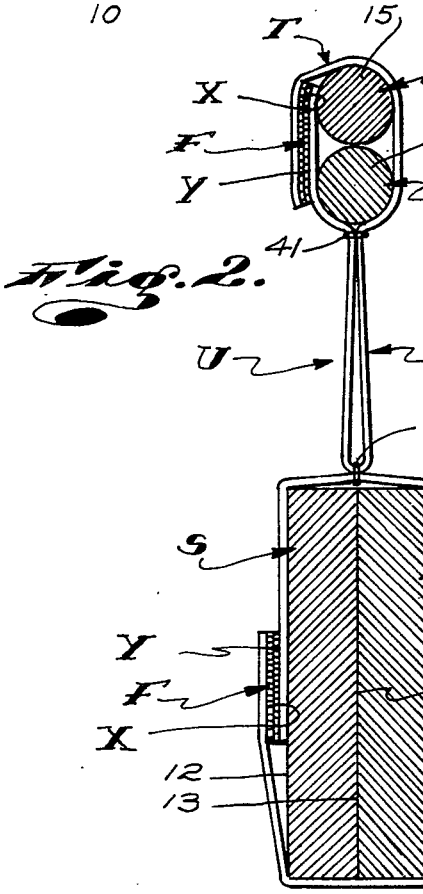
FIG. 2 is an enlarged vertical sectional view taken as indicated by line 2—2 on FIG. 1.

In carrying out the invention, a pair of skis are first arranged in substantially horizontal parallel relationship (FIG. 2) with their bottom surfaces 13 in flat bearing engagement with each other and with their top surfaces disposed laterally outwardly.

The ski poles P are also typical. Each comprises an elongate, semi-rigid, generally cylindrical shaft 15 with lower and upper ends 16 and 17, respectively. The lower ends of the poles are pointed and the lower end portions are provided with enlarged snow surface-engaging stop discs R, which are usually made of plastic. The upper end portion of each shaft is provided with a hand grip 18, which can include a segmented arcuate retaining band 19 or be provided with a wrist-engaging loop 20.

Secondly, the ski poles are arranged in a substantial horizontal side-by-side, reversed end-to-end relationship, with the end of the handle 18 of one pole placed against the upper surface of the stop disc R of the other pole, whereby the shafts occur in substantial side-by-side relationship as shown in FIG. 1 of the drawings.

The pairs of poles and skis are arranged in vertical spaced parallel relationship such that sufficient space to freely accommodate one's hand engaged about the poles, occurs between the skis and poles intermediate the ends of the assembly.

Figure 3:
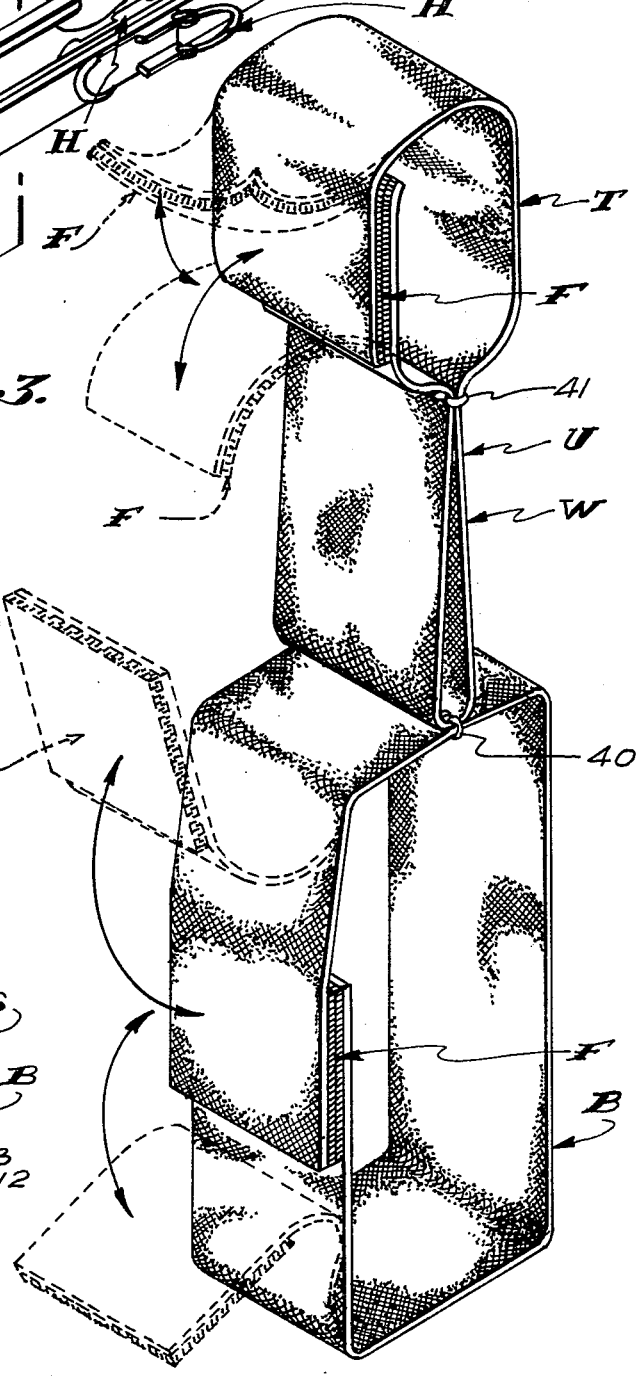
FIG. 3 is an enlarged isometric view of one coupling strap, showing parts in the open position in broken lines.

The coupling units U (FIG. 3) are alike, and each includes a large lower ski-engaging loop B, an upper pole-engaging loop T and a vertical intermediate web W. The units U are flexible and are preferably produced from woven fabric webbing. The top and bottom loops are split and are provided with overlapping free end portions which cooperate to define opposing surfaces X and Y. The end portions of the loops are provided with fastening means F to releasably secure the end portion together, with the surfaces X and Y in substantial flat opposing relationship with each other.

In practice, the fastening means can be in the form of buttons and buttonholes, snaps, and the like. However, in the preferred construction, the fastener means F comprises opposing mating patches of fabric with interengageable hook and loop pile and which is sold under the trademark "Velcro". The advantages afforded by "Velcro" fastening means resides in the fact that the loops can be fastened and unfastened during daylight and in darkness, when the units U are wet or dry, and when the skier is wearing gloves. Also, they provide for any reasonable adjustment as might be required with skis and poles of different sizes.

The web W of each coupling unit U can be a simple loop between the loops T and B, or can, as shown, be joined integrally with the loops and/or established by portions of the webbing employed to establish the loops.

In the embodiment which is illustrated, the top and bottom loops are established by two separate, similar loops of webbing. The two loops of webbing are engaged in tangential side-by-side relationship and are stitched together as at 40. The upper loop T is flattened or collapsed and is stitched across its central portion as at 41 to reduce the effective circumferential extent of that loop, whereby tight engagement of the loop about a pair of ski poles can be established. The remaining portion of the loop T established by the stitching 40 defines the web W. This one manner of establishing the units U is extremely simple, effective and economical. At present, the above structure and method of producing the units U is preferred over all other ways and/or means because it requires no special or costly tooling, and requires very little labor.

The units U, as noted above, are positioned adjacent the central portions of their related pairs of skis and ski poles in longitudinal spaced relationship relative to each other. With reference to the center of gravity of the assembly of skis and ski poles, the units U are arranged so that one occurs forward of the center of gravity and the other occurs rearward of the center of gravity. With such a relationship of parts, the portions of the ski poles which occur at or near the center of gravity of the skis and pole assembly define a hand-grip area which enables a skier to grip, support and carry the assembly with one hand, in a convenient and balanced manner.

The units U effectively releasably keep the pairs of skis in assembled relationship, the ski poles in assembled relationship and the ski assemblies and poles assemblies in parallel relationship.

It will be apparent that when the assembly is carried to a site where the skis and ski poles are to be put to their intended use, the loops of the units U are simply and quickly opened, releasing the skis and ski poles for immediate use. The flexible units U can then be folded into a small volume and deposited in a pocket of the skier's clothing or the like, where they remain for immediate and convenient use.

Thus, it is apparent that there has been provided a novel carrier for skis and ski poles, which fulfills all of the objects and advantages sought therefor.

I claim:

1. A carrier assembly for carrying a pair of skis and a pair of ski poles, comprising:

a pair of coupling straps, each of which is made wholly of flexible material and which includes top and bottom loops and an intermediate portion therebetween;

the bottom loop being of a size to encircle a pair of skis placed in side-by-side relationship, the top loop being of a size to encircle a pair of ski poles placed in side-by-side relationship, and the intermediate portion being of a length to provide a finger-clearing space between the top and bottom loops when in use;

one of said loops and the intermediate portion of each strap comprising a unitary strip of flexible material doubled back upon itself to provide the loop at one end of the intermediate portion, and the other loop comprising a unitary strip of flexible material fastened intermediate the ends thereof to the end of said intermediate portion opposite from said one loop; and each of said loops being split and having overlapping end portions with pressure-engagable fastening means for adjustably and releasably securing said end portions together.

2. A carrier assembly as in claim 1, in which each strap is made of webbing material, said one loop and the intermediate portion are separated by cross-stitching, and said other loop is fastened to said intermediate portion by cross-stitching.

* * * * *